US005702236A

United States Patent [19]

Ikeda

[11] Patent Number: 5,702,236

[45] Date of Patent: Dec. 30, 1997

[54] RECIPROCATING PISTON TYPE COMPRESSOR HAVING A DISCHARGE CHAMBER WITH A PLURALITY OF PULSATION ATTENUATING SUBCHAMBERS

[75] Inventor: Hayato Ikeda, Kariya, Japan

[73] Assignee: Kabushiki Kaisha Toyoda Jiboshokki Seisakusho, Kariya, Japan

[21] Appl. No.: 391,439

[22] Filed: Feb. 21, 1995

[30] Foreign Application Priority Data

Feb. 23, 1994 [JP] Japan ..... 6-025331

[51] Int. Cl.[6] ..... F04B 1/12

[52] U.S. Cl. ..... 417/269; 417/312; 181/403

[58] Field of Search ..... 417/269, 312; 181/403

[56] References Cited

U.S. PATENT DOCUMENTS

| | | | |
|---|---|---|---|
| 3,930,758 | 1/1976 | Park | 417/269 |
| 4,583,922 | 4/1986 | Iijima et al. | 417/269 |
| 4,761,119 | 8/1988 | Nomura et al. | 417/312 |
| 4,813,852 | 3/1989 | Ikeda et al. | 417/269 |
| 4,930,995 | 6/1990 | Suzuki et al. | 417/312 |
| 4,936,754 | 6/1990 | Suzuki et al. | 417/269 |
| 5,100,301 | 3/1992 | Hidaka et al. | 417/269 |
| 5,232,349 | 8/1993 | Kimura et al. | 417/269 |

FOREIGN PATENT DOCUMENTS 113164 1/1989 Japan .

*Primary Examiner*—Timothy Thorpe
*Assistant Examiner*—Ted Kim
*Attorney, Agent, or Firm*—Burgess, Ryan & Wayne

[57] ABSTRACT

A reciprocating piston type compressor provided with pistons reciprocating in respective cylinder bores arranged in a cylinder block for compression of refrigerant gas in response to rotation of a reciprocation-drive-mechanism including a rotating drive shaft, a suction chamber receiving the refrigerant gas before compression and communicating with the cylinder bores via suction ports of a valve assembly, and a discharge chamber receiving the compressed refrigerant gas and communicating with the cylinder bores via discharge ports of the valve assembly, the discharge chamber being divided into a plurality of sub-chambers arranged to be in registration with the plurality of discharge ports of the valve assembly for attenuating pulsative components in the pressure of the compressed refrigerant gas, and the sub-chambers being sectioned by ribs having fluid passageways for providing communication among the sub-chambers.

4 Claims, 7 Drawing Sheets

RECIPROCATING PISTON TYPE COMPRESSOR HAVING A DISCHARGE CHAMBER WITH A PLURALITY OF PULSATION ATTENUATING SUBCHAMBERS

FIELD OF THE INVENTION

The present invention relates to a reciprocating piston type refrigerant compressor provided with means suitable for reducing the discharge pressure pulsation of compressed refrigerant gas.

DESCRIPTION OF THE RELATED ART

Japanese Unexamined Utility Model Publication No. 1-113164 discloses a reciprocating piston type refrigerant compressor provided with a cylinder block having a plurality of parallel cylinder bores formed so as to be arranged around an axial drive shaft rotatably held by the cylinder block and a front housing sealingly attached to one axial end of the cylinder block. Refrigerant gas is compressed by pistons reciprocating in the cylinder bores of the cylinder block.

The compressor is further provided with a valve assembly attached to the other axial end of the cylinder block and having suction and discharge ports communicating with the cylinder bores, and a rear housing defining therein a suction chamber communicated with the respective suction ports and a discharge chamber communicated with the respective discharge ports. The suction chamber is arranged so as to extend around the discharge chamber in the rear housing which is sealingly attached to the above-mentioned other axial end of the cylinder block via the valve assembly.

The discharge chamber of the rear housing is formed with a plurality of depressions or recesses located so as to axially face the respective discharge ports for reducing and weakening discharge pressure pulsation of discharge gas under high pressure. Namely, when the compressed refrigerant gas discharges from the respective cylinder bores toward the discharge chamber, the gas is received by the respective depressions in the discharge chamber, and accordingly, it is possible to prevent the refrigerant gas discharging through the respective discharge ports of the valve assembly from directly colliding. Moreover, the pulsative components in the high pressure of the compressed refrigerant gas discharging from the respective cylinder bores are weakened by the respective depressions of the discharge chamber. Thus, when the compressed refrigerant gas is delivered from the discharge chamber of the compressor toward an external refrigerating circuit, the gas does not produce appreciable vibrations and noise in the refrigerating circuit.

The refrigerant compressor of the Japanese Unexamined Utility Model Publication No. 1-113164, however, is configured so that a second discharge chamber is formed in the rear housing so as to be arranged radially internally with respect to the above-mentioned pulsation-weakening-depressions, for receiving all of the compressed gas. Namely, the second discharge chamber is provided for delivering the received compressed gas toward the external refrigerating circuit, and is enclosed by a wall in which small diameter holes are bored so as to provide a fluid communication between the respective depressions and the second discharge chamber.

Nevertheless, from the viewpoint of the manufacture of the reciprocating piston type compressors, a process for boring the above-mentioned holes in the wall is considerably cumbersome, and is apt to increase the manufacturing cost of the compressors.

SUMMARY OF THE INVENTION

Therefore, an object of the present invention is to eliminate the above-mentioned defect encountered by the reciprocating piston type refrigerating compressor with a discharge pressure pulsation weakening means according to the prior art.

Another object of the present invention is to provide a reciprocating piston type refrigerant compressor provided with means for reducing or weakening pulsation in the discharge pressure of the compressed refrigerant gas, and capable of being manufactured without employing a cumbersome manufacturing process.

A further object of the present invention is to provided a reciprocating piston type refrigerant compressor provided with low cost means for reducing or weakening pulsation in the discharge pressure of the compressed refrigerant gas, whereby neither vibrations nor noises are produced in the refrigerating circuit in which the compressor is accommodated.

In accordance with the present invention, there is provided a reciprocating piston type refrigerant compressor including a cylinder block provided with a plurality of parallel cylinder bores formed therein and arranged around an axial drive shaft for driving a compressing motion of reciprocating pistons in the cylinder bores, a valve assembly closely attached to an axial end of the cylinder block and provided with suction and discharge ports communicating with the respective cylinder bores, and a housing unit sealingly attached to the same axial end of the cylinder block via the valve assembly and defining therein a suction chamber receiving a refrigerant gas before compression and fluidly communicated with the respective suction ports of the valve assembly and a discharge chamber receiving therein a compressed refrigerant gas and fluidly communicated with the discharge ports of the valve assembly, wherein the discharge chamber is fluidly isolated from the suction chamber by a wall, and generally annularly extends so as to surround the suction chamber, and wherein the discharge chamber comprises a plurality of sub-chamber communicated, respectively, with one of the plurality of the discharge ports of the valve assembly so as to weaken pulsation of the discharge pressure of the compressed gas discharging from the respective cylinder bores, the sub-chambers being sectioned by radial ribs extending from the bottom of the discharge chamber toward the valve assembly, the respective ribs defining fluid passageways, in the form of a flow choke, which are arranged between the ends of the ribs and the valve assembly so as to provide a fluid communication among the plurality of sub-chambers.

Preferably, one of the plurality of sub-chambers of the discharge chamber is provided with a delivery port for delivering the compressed refrigerant gas toward a refrigerating circuit in which the reciprocating piston type refrigerant compressor is incorporated. The sub-chamber provided with the delivery port is sectioned from the neighboring sub-chambers by ribs standing from the bottom of the discharge chamber and defining fluid passageways in the form of a fluid choke, respectively, which are arranged adjacent to the valve assembly. The fluid passageways in the form of the fluid chokes, defined by the respective ribs are formed in such a manner that the sectional areas of the fluid passageways defined by the ribs located closer to the sub-chamber having the delivery port are larger than those defined by the ribs located far from the same sub-chamber having the delivery port.

Alternately, one additional sub-chamber may be juxtaposed with the plurality of sub-chambers in such a manner that the additional sub-chamber is fluidly communicated with all of the plurality of sub-chambers, and only the additional sub-chamber is provided with a delivery port for delivering the compressed gas therefrom toward a refrigerating circuit in which the reciprocating piston type refrigerant compressor is incorporated. The additional sub-chamber is arranged so as not to confront any one of the discharge ports of the valve assembly.

Preferably, the ribs are formed integrally with the housing unit.

In the above-mentioned reciprocating piston type compressor, the compressed refrigerant gas discharging from each of the plurality of cylinder bores enters each of the plurality of sub-chambers of the discharge chamber, and accordingly, the compressed refrigerant gas discharging from one cylinder bore can be prevented from interfering with the refrigerant gas discharging from different cylinder bores within the discharging chamber.

The discharge chamber arranged in the housing unit is formed by a single annular chamber circularly surrounding the suction chamber, and therefore the discharge chamber can be easily sectioned into the plurality of sub-chambers by using the ribs extending from the bottom of the discharge chamber. The plurality of sub-chambers are fluidly communicated with one another through the fluid passageways, in the form of a flow choke, which are defined between the ends of the ribs and the valve assembly. Only one of the plurality of sub-chambers of the discharge chamber is used as a gas delivery chamber provided with a delivery port connected to an external refrigerating circuit so that the compressed refrigerant gas discharged into the respective sub-chambers flows toward the gas delivery chamber through the fluid passageways in the form of a flow choke thereby being delivered toward the refrigerating circuit through the delivery port. Namely, the compressed refrigerant gas is subjected to repetitive expansion and contraction while flowing through the several sub-chambers and the fluid passageways in the form of a flow choke before it is delivered from the delivery port. Thus, pulsative components in the discharge pressure of the compressed refrigerant gas are gradually attenuated before the gas is delivered toward the external refrigerating circuit. Therefore, the compressed refrigerant gas delivered from the compressor can suppress production of any perceptible vibration and noise in the refrigerating circuit.

It should be appreciated that the fluid passageways in the form of a flow choke defined between the ends of the ribs and the valve assembly can be easily provided by either controlling the height of each rib extending from the bottom of the discharge chamber or forming a recess in the end of each rib. Namely, the fluid passageways in the form of a flow choke can be presented when the housing unit is die-cast without relying on the method of boring small flow choke holes in the ribs by a cutting tool.

Furthermore, since lubricating oil component contained in the compressed refrigerant gas is separated from the gas during flowing of the compressed refrigerating gas through several fluid passageways in the form of a flow choke within the discharge chamber, the separated lubricating oil component is held in each of the sub-chambers. Accordingly, the lubricating oil is not delivered to the refrigerating circuit to thereby guarantee lubrication of the internal construction of the reciprocating piston type refrigerant compressor.

BRIEF DESCRIPTION OF THE DRAWINGS

The above and other objects, features and advantages of the present invention will be made more apparent from the ensuing description of the preferred embodiments thereof with reference to the accompanying drawings wherein.

DESCRIPTION OF THE PREFERRED EMBODIMENTS

Figure 1:
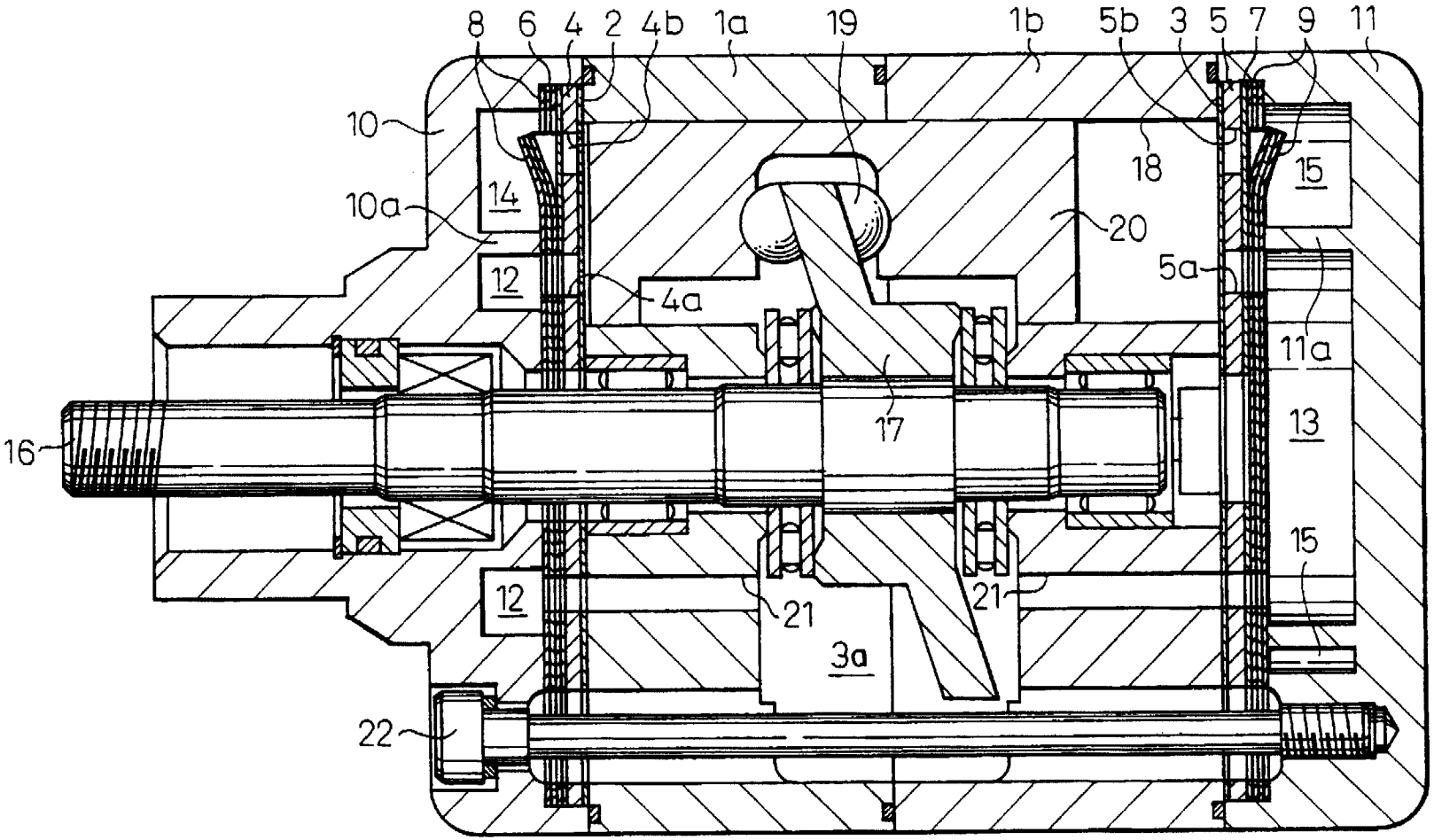
FIG. 1 is a longitudinal cross-sectional view of a reciprocating piston type refrigerant compressor according to an embodiment of the present invention.

Referring to FIG. 1, a double-headed reciprocating piston type refrigerant compressor is provided with a pair of cylinder blocks 1*a* and 1*b* axially connected together by means of screw bolts 22 so as to form an integral axial cylinder block assembly, a drive shaft 16 rotatably held by the cylinder block assembly via a pair of anti-friction bearings, and front and rear housings 10 and 11. The integral cylinder block assembly is provided with a plurality of cylinder bores (five cylinder bores) 18 arranged in parallel around the axis of rotation of the drive shaft 16, and a central swash plate chamber 3*a* in which a swash plate 17 mounted on the drive shaft 16 is received so as to be rotated together with the drive shaft. The cylinder block 1*b* of the integral cylinder block assembly is provided with a flange portion (not shown in FIG. 1) through which the swash plate chamber 3*a* can be fluidly connected to an evaporator arranged in an external refrigerating circuit.

The front end of the front cylinder block 1*a* is sealingly closed by the front housing 10 via an inner suction valve member 2, an intermediate valve plate 4, an outer discharge valve member 6, and a retainer member 8 having a gasket integral therewith. The rear end of the rear cylinder block 1*b* is sealingly closed by the rear housing 11 via an inner suction valve member 3, an intermediate valve plate 5, an outer discharge valve member 7, and a retainer 9 having a gasket integral therewith. The suction valve members 2,3; the valve plates 4,5; the discharge valve members 6,7; and the gasket-accommodated retainers 8,9 constitute front and rear valve assemblies for the double-headed reciprocating piston type compressor of the present embodiment.

The front and rear housings 10 and 11 are provided with radially inner suction chambers 12 and 13, and radially outer discharge chambers 14 and 15. Thus, the former chambers 12 and 13 are arranged so as to surround the latter chambers 14 and 15, and are fluidly isolated from one another by means of isolating walls 10*a* and 11*a* formed integrally with the front and rear housings 10, and 11. The ends of the isolating walls 10*a* and 11*a* are in tight contact with the gasket-accommodated retainers 8 and 9.

The front and rear valve assemblies are formed with a plurality of suction ports (five suction ports) 4*a* and 5*a*, and a plurality of discharge ports (five discharge ports) 4*b* and 5*b*, so that the respective cylinder bores 18 can fluidly communicate with the front and rear suction chambers 12 and 13, via the suction valves elements 2 and 3 which open and close the suction ports 4*a* and 5*a*, and with the front and rear discharge chambers 14 and 15, via the discharge valve elements 6 and 7 which open and close the discharge ports 4*b* and 5*b*.

The front and rear suction chambers 12 and 13 commonly communicate with the swash plate chamber 3*a* via a plurality of suction passageways (e.g., five passageways) 21 as best shown in FIG. 1. The front and rear discharge chambers 14 and 15 mutually communicate by a single delivery passageway 23 (see FIG. 2) which can be fluidly connected to a refrigerant condenser in the external refrigerating circuit via a flange portion (not shown) formed in the rear cylinder block 1*b*.

One end of the drive shaft 16, i.e., a front end of the drive shaft 16 extends through the front housing 10 toward the external of the compressor, so that the compressor can be connected to a rotary drive source, such as an automobile engine via an appropriate transmission mechanism. The rotation of the drive shaft 16 rotates the inclined swash plate 17 which is engaged with each of a plurality of double-headed pistons 20 fitted in the cylinder bores 18 via shoes 19 socketed in respective pistons 20. Namely, the rotation of the drive shaft 16 and the swash plate 17 causes reciprocation of the double-headed pistons 20 in the cylinder bores 18 to thereby compress refrigerant gas in the cylinder bores 18.

Figure 2:
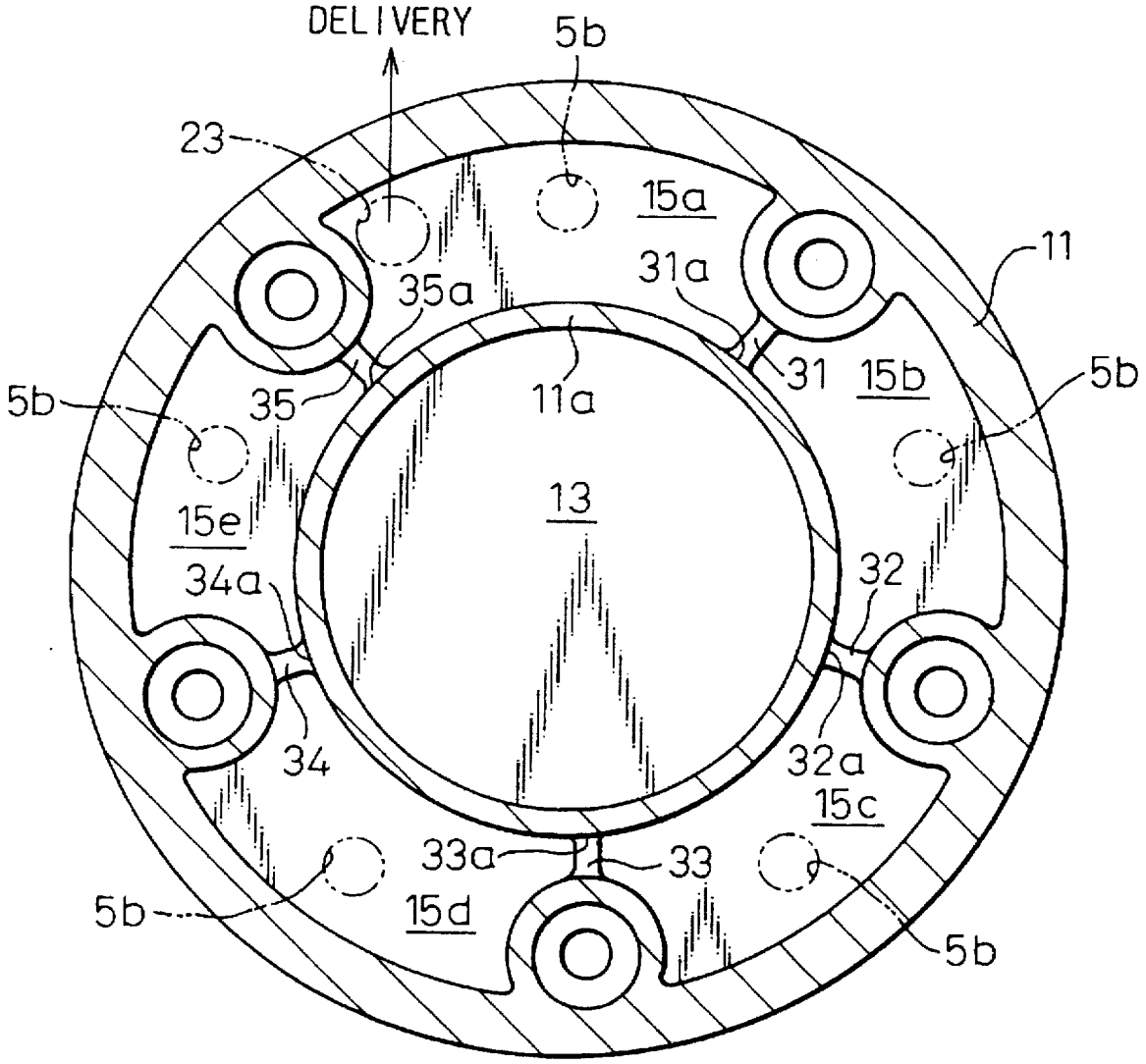
FIG. 2 is a plan view of a rear housing of the compressor as shown in FIG. 1, illustrating an arrangement of suction and discharge chambers formed in the rear housing.
Figure 3:
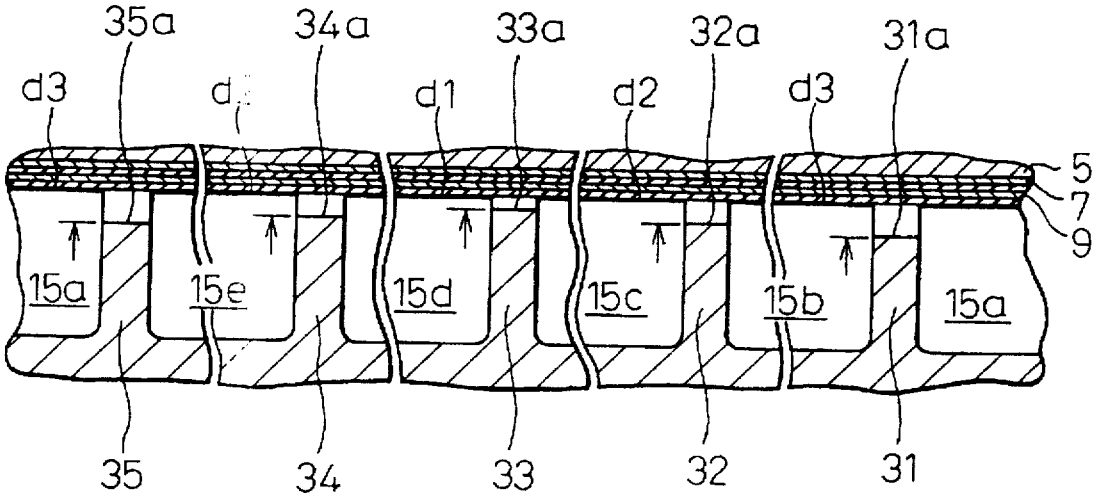
FIG. 3 is a foreshortened fragmentary cross-sectional view, in development, of an arrangement of the sub-chambers of the discharge chamber of the compressor of FIG. 1.

Referring now to FIGS. 2 and 3 in connection with FIG. 1, the rear discharge chamber 15 arranged in the rear housing 11 is divided into a plurality of sub-chambers (five sub-chambers) 15*a* through 15*e* which are sectioned by ribs 31 through 35. The ribs 31 through 35 in the form of radial walls axially extending from the bottom of the discharge chamber 15 toward the rear valve assembly are provided so as to be integral with boss-forming portions of a circumferential wall of the rear housing 11. The boss-forming portions are provided with threaded bores in which the screw bolts 22 are threadedly engaged.

One of the sub-chambers 15*a* through 15*e*, i.e., the sub-chamber 15*a* communicate directly with the afore-mentioned delivery passageway 23.

It should be noted that the ribs 31 through 35 of the rear housing 11 can be formed by casting when the rear housing 11 per se is made by casting of metallic material such as aluminum material. As best shown in FIG. 3, the ribs 31 through 35 are formed so as to have axial heights lower than the circumferential wall of the rear housing 11, and accordingly, there are provided small spacings 31*a* through 35*a* between respective ends of the ribs 31 through 35 and the retainer 9 of the rear valve assembly. The small spacings 31*a* and 35*a* are provided to work as fluid passageways providing a fluid communication between all of the sub-chambers 15*a* through 15*e* during the operation of the compressor, and to act as a flow choke, providing the flow of the compressed refrigerant gas passing through the fluid passageways 31*a* through 35*a* with a contracting effect.

It should be understood that since the fluid passageways 31*a* through 35*a* in the form of a flow choke can be formed by the afore-mentioned casting method without relying on the cutting and boring method carried out by a machine tool, the formation of the fluid passageways 31*a* through 35*a* can be simpler and easier.

At this stage, the fluid passageways 31*a* through 35*a* are formed so as to have an identical radial width as is obvious from FIG. 2, but have different axial depths as clearly shown in FIG. 3. Namely, the depth d1 of the fluid passageway 33*a* is smaller than the depth d2 of the fluid passageways 32*a* and 34*a*, and the depth d2 of the fluid passageways 32*a* and 34*a* is smaller than the depth d3 of the fluid passageways 31*a* and 35*a*. More specifically, the fluid passageways are set in such a manner that the deeper they are the closer to the sub-chamber 15*a* the location thereof is.

Although the above-description is particularly directed to the construction and arrangement of the discharge chamber 15 of the rear housing 11 and the rear valve assembly in conjunction with FIGS. 2 and 3, it should be understood that the front discharge chamber 14 of the front housing 10 and the front valve assembly have the same arrangement and construction as the above-mentioned rear discharge chamber 15 and the rear valve assembly.

From the foregoing description, it will be understood that since the compressed refrigerant gas discharging from the cylinder bores 18 through the front and rear discharge ports 4*b* and 5*b* enters the respective sub-chambers of the front and rear discharge chambers 14 and 15 such as the sub-chambers 15*a* through 15*e* sectioned by the ribs 31 through 35, it is possible to prevent occurrence of interference of the flow of the compressed refrigerant gas under high pressure within both discharge chambers 14 and 15.

Further, since the front and rear discharge chambers 14 and 15 are arranged so as to annularly surround the front and rear suction chambers 12 and 13, respectively, both chambers 14 and 15 can be simple annular chambers. Thus, when only one of the plurality of sub-chambers of each of the front and rear discharge chambers 14 and 15, i.e., the sub-chamber 15*a* of the rear discharge chamber 15 and the similar sub-chamber of the front discharge chamber 14 communicate with the delivery passageway 23, it is ensured that a fluid communication is provided between all of the front and rear sub-chambers of the front and rear discharge chambers 14 and 15, and the external refrigerating circuit. Accordingly, the compressed refrigerant gas discharged from respective cylinder bores 18 into respective front and rear sub-chambers other than the rear sub-chamber 15*a* and the corresponding front sub-chamber is subjected to expansion and contraction while it flows through the fluid passageways in the form of a flow choke and one or more sub-chambers in the front and rear discharge chambers 14 and 15. For example, the compressed refrigerant gas discharged from the cylinder bore 18 into the rear sub-chamber 15*c* remote from the rear sub-chamber 15*a* is first subjected to expansion when it enters the sub-chamber 15*c* per se. Subsequently, the compressed refrigerant gas is subjected to contraction when it flows through the fluid passageways 32*a* and 33*a*. Then, the compressed refrigerant gas is subjected to expansion when it enters the sub-chambers 15*b* and 15*d*. Thus, before the compressed refrigerant gas arrives the sub-chamber 15*a*, the gas is subjected repetitive expansions and contractions. Therefore, pulsative components in the pressure of the compressed refrigerant gas can be sufficiently attenuated before it is delivered toward the external refrigerating circuit via the delivery passageway 23.

It should be understood from the foregoing that the refrigerant compressor according to the present embodiment having the above-mentioned arrangement in which the discharge chambers 14 and 15 are defined so as to surround the suction chambers 12 and 13 in the front and rear housings 10 and 11, can be effective for reducing vibration and noise caused by the pulsative pressure of the compressed refrigerant gas compared with the compressor according to the prior art in which the cylindrical discharge chamber is surrounded by the suction chamber in the housing.

It should also be understood that, according to the present embodiment the formation of the fluid passageways in the form of a flow choke is very simplified due to the arrangement of the afore-described ribs defining the fluid passageways between the ends thereof and the front and rear valve assemblies. Namely, the fluid passageways, e.g., passageways 31*a* through 35*a*, can be formed in the respective ribs during the casting process for making the housings 10 and 11, so no additional machining process is needed. Thus, manufacturing cost of the ribs and the fluid passageways of the front and rear housings is not increased.

Moreover, in the above-described embodiment of the present invention, lubricating oil component suspended in the compressed refrigerant gas is separated from the gas during the above-mentioned contraction phase in the flow of the compressed refrigerant gas passing through the fluid passageways in the form of a flow choke, and the separated lubricating oil is received in the respective sub-chambers such as those 15*a* through 15*e*. Accordingly, the compressed refrigerant gas does not carry the lubricating oil when it is delivered from the discharge chambers 14 and 15 toward the external refrigerating circuit. Thus, the compressor does not fail due to lack of lubrication. This brings about an additional benefit that when the oil-separated compressed refrigerant gas is circulated through the refrigerating circuit, heat exchanging efficiency of the circuit can be high.

Furthermore, in the above-mentioned refrigerant compressor of the present invention, the fluid passageways such as passageways 31*a* through 35*a* are gradually increased in their sectional areas with respect to the sub-chamber 15*a* having direct fluid communication with the delivery passageway 23, so the compressed refrigerant gas flowing through the fluid passageways in the form of flow choke is not subjected to a large pressure loss before arriving at the rear sub-chamber 15*a* and the corresponding front sub-chamber. Thus, the compressor according to the present embodiment of the present invention can exhibit a high compression efficiency.

Figure 4:
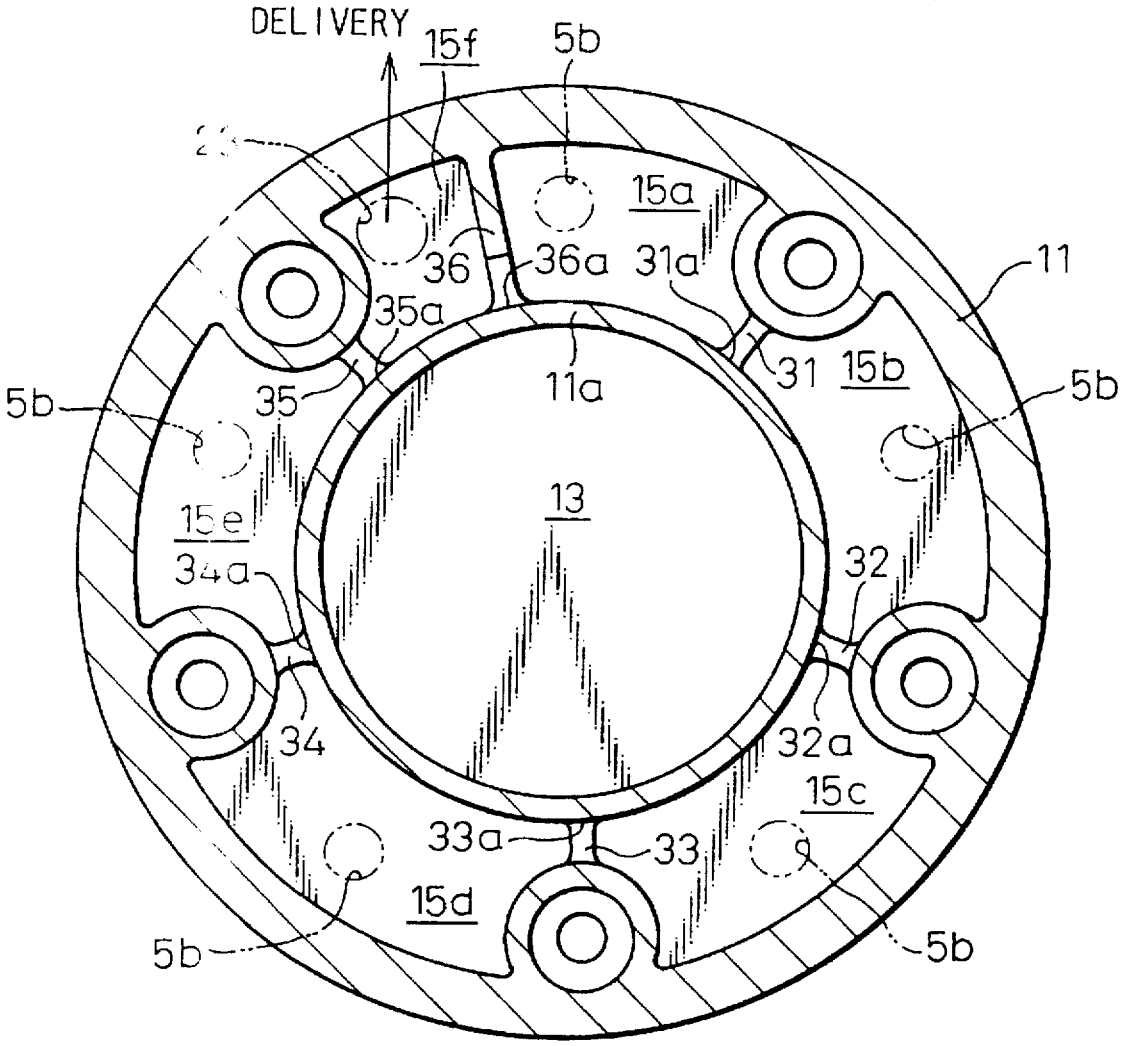
FIG. 4 is a plan view of a rear housing, illustrating an arrangement of a discharge chamber provided with a plurality of sub-chambers of which the construction is modified from that shown in FIG. 2.

Referring to FIG. 4 in association with FIG. 1, the construction and arrangement of the discharge chambers 14 and 15 are different from those shown in FIGS. 2 and 3 in that an additional sub-chamber 15*f* which directly communicate with the delivery passageway 23 is independently defined by an additional rib 36 at a position adjacent to the sub-chamber 15*a* within the rear housing 15. The rib 36 is provided with an additional fluid passageway 36*a* to provide fluid communication between the sub-chambers 15*a* and 15*f*.

The corresponding additional sub-chamber and the additional fluid passageway are also defined in the front housing 14.

The radial width of the fluid passageway 36*a* is preferably identical with that of the fluid passageways 31*a* and 35*a*, and the axial depth of the fluid passageway 36*a* is preferably equal to that of the fluid passageway 35*a* of the rib 35.

In the reciprocating piston type refrigerant compressor 35 including the discharge chambers 14 and 15 as illustrated in FIG. 4, the compressed refrigerant gas is collected into the sub-chamber 15*f* and into the corresponding front sub-chamber from the respective sub-chambers such as those 15*a* through 15*e*, after being subjected to contraction by the several fluid passageways such as passageways 31*a* through 36*a*, and the collected gas is delivered through the delivery passageway 23 toward the external refrigerating circuit.

At this stage, since the rear sub-chamber 15*f* and the corresponding front sub-chamber do not directly communicate with any one of the cylinder bores 18, when the compressed refrigerant gas enters into the sub-chamber 15*f* and the corresponding front sub-chamber from the other sub-chambers, the flow of the refrigerant gas is not interfered with by any other flow of the gas. Therefore, the compressed refrigerant gas under a steady flow condition is delivered toward the external refrigerating circuit. Accordingly, prevention of vibration and noise in the external refrigerating circuit is appreciably enhanced by the embodiment of FIG. 4.

Further, the provision of the sub-chamber 15*f* and the fluid passageway 36*a* in the form of a flow choke can contribute to additional separation of the lubricating oil from the compressed refrigerant gas during passing of the gas through the fluid passageway 36*a*, so the compressed gas can implement an effective heat-exchanging performance within the refrigerating circuit.

Figure 5:
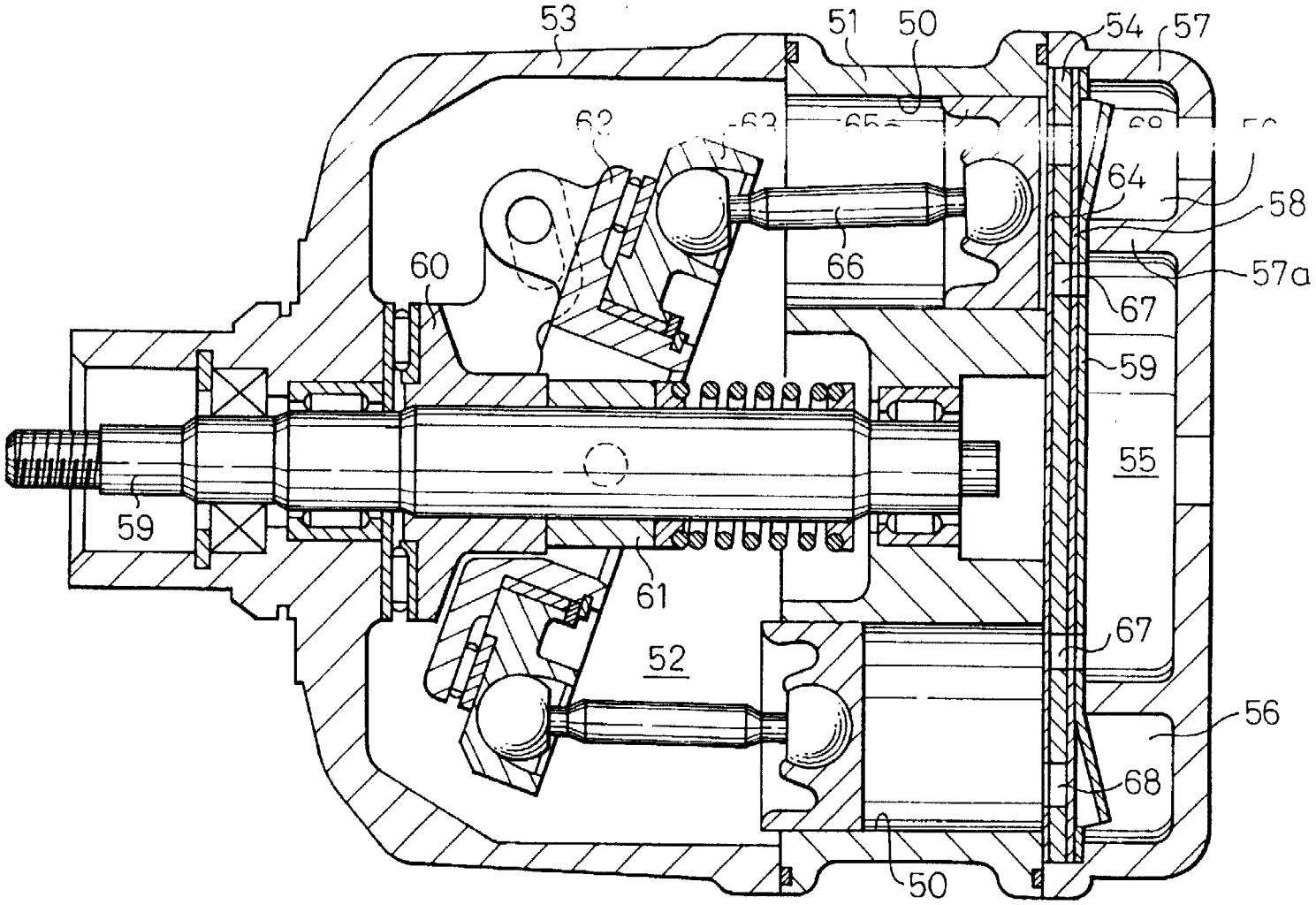
FIG. 5 is a longitudinal cross-sectional view of a reciprocating piston type refrigerant compressor according to another embodiment of the present invention.
Figure 6:
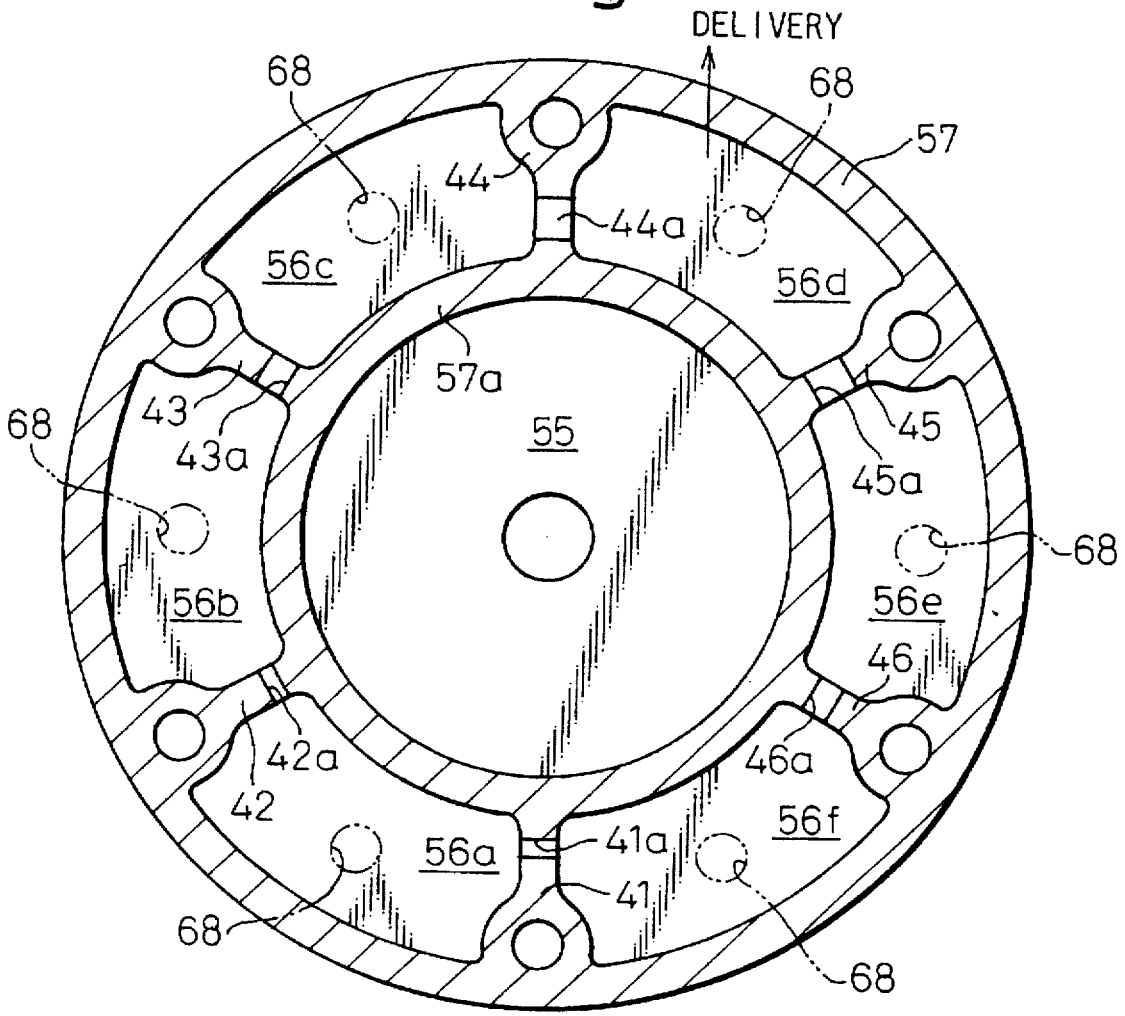
FIG. 6 is a plan view of a rear housing accommodated in the compressor of FIG. 5, illustrating an arrangement of a discharge chamber provided with a plurality of sub-chambers sectioned by ribs; and, FIG. 7 is a fragmentary plan view, in development, of the sub-chambers shown in FIG. 6.
Figure 7:
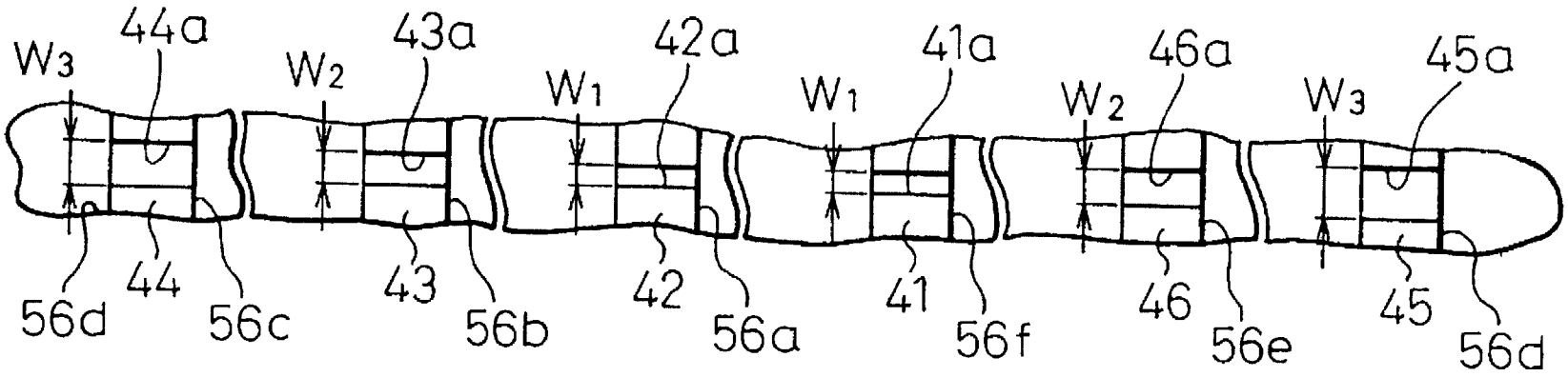

Referring to FIGS. 5 through 7, a reciprocating piston type refrigerant compressor according to a different embodiment of the present invention is shown in which the compressor is formed as a variable capacity wobble plate type compressor.

The refrigerant compressor of the present embodiment is provided with a cylinder block 51, a front housing 53 sealingly connected to a front end of the cylinder block 51 by screw bolts (not shown), and a drive shaft 59 rotatably supported by anti-friction bearings seated in the cylinder block 51 and the front housing 53.

The cylinder block 51 is provided with a plurality of cylinder bores (six cylinder bores) 50 arranged in parallel around the axis of rotation of the drive shaft 59 and receiving reciprocating pistons 65.

The front housing 53 defines a crank chamber 52 therein so as to receive a rotor 60 fixedly mounted on the drive shaft 59 and a rotating swash plate 62 mounted around the drive shaft 59 and pivotally connected to the rotor 60 via a hinge mechanism so as to change an angle of inclination of the swash plate 62 with respect to a plane perpendicular to the axis of rotation of the drive shaft 59. The rotating swash plate 62 supports thereon a non-rotatable wobble plate 63 via a thrust bearing, and the wobble plate 63 is operatively connected to the respective pistons 65 via piston rods 66. Thus, the pistons 65 reciprocate in the cylinder bores 50 in response to the rotation of the drive shaft 59 and the swash plate 62. The stroke of the respective pistons 65 is determined by an angle of inclination of the swash plate 62 and accordingly, an angle of inclination of the wobble plate 63. The reciprocation of the respective pistons 65 causes suction of a refrigerant gas, compression of the refrigerant gas, and discharge of the compressed refrigerant gas.

The rear end of the cylinder block 51 is sealingly closed by a rear housing 57 via a valve assembly including a suction valve element 64, a valve plate 54, a discharge valve element 58, and a retainer 59 integral with a gasket member. The rear housing 57 is tightly connected to the cylinder block 51 by screw bolts (not shown in FIGS. 5 through 7).

The rear housing 57 which is made by the die-casting method of metallic material such as aluminum is provided with a cylindrical wall 57*a* formed so as to axially extend from the bottom of the rear housing 57 and to abut against the valve assembly. The cylindrical wall 57*a* forms an isolating wall between an inner suction chamber 55 and an outer discharge chamber 56 while extending so as to surround the inner suction chamber 55.

The suction chamber 55 is communicated with the respective cylinder bores 50 through respective suction ports 67 which are formed in the valve plate 54, the discharge valve element 58, and the retainer 59 of the valve assembly, and are opened and closed by the suction valve elements 64.

The discharge chamber 56 is communicated with the respective cylinder bores 56 through respective discharge ports 68 which are formed in the suction valve element 64, and the valve plate 54 of the valve assembly, and are opened and closed by the discharge valve element elements 58. The suction chamber 55 is fluidly connected to an evaporator in an external refrigerating circuit, and the discharge chamber 56 communicates with a condenser of the refrigerating circuit.

As best shown in FIGS. 6 and 7, the rear discharge chamber 56 of the rear housing 57 is divided into a plurality of radial ribs 41 through 46 integrally formed with an outermost cylindrical wall portion of the rear housing 57. The outermost cylindrical wall portion of the rear housing 57 is provided for forming a plurality of boss portions for defining threaded holes therein to be engaged with the afore-mentioned screw bolts for combining the housings 53*a* and 57 with the cylinder block 51.

The radial ribs 41 through 46 radially extending between the above-mentioned outermost cylindrical wall portion and the inner cylindrical wall 57*a* divide the discharge chamber 56 into a plurality of sub-chambers 56*a* through 56*f* confronting one of the plurality of discharge ports 68 of the valve assembly. At this stage, one of the sub-chambers, i.e., the sub-chamber 56*d* is directly connected to the condenser of the external refrigerating circuit.

As clearly shown in FIG. 7, axial ends of respective ribs 41 through 46 are formed with recesses used as fluid passageways 41*a* through 46*a* communicating with the sub-chambers 56*a* through 56*f*. The fluid passageways 41*a* through 46*a* act as a flow choke between the neighboring sub-chambers. Since the fluid passageways 41*a* through 46*a* are formed as recesses provided in the respective ribs 41 through 46 of the rear housing 57, they are easily formed during die-casting of the rear housing 57. Namely, the fluid passageways 41*a* through 46*a* are formed without relying on the machining method.

The fluid passageways 41*a* through 46*a* have an identical depth but have different radial widths W1 through W3, as shown in FIG. 7. The width W3 is larger than the width W2, and the width W2 is larger W1. Namely, the fluid passageways located closer to the sub-chamber 56*d* are wider than those located far from the same sub-chamber 56*d*.

In accordance with the construction and arrangement of the discharge chamber 56 of the rear housing 57, each of the sub-chambers 56*a* through 56*f* is provided for each of the discharge port 68, the compressed refrigerant gas discharging from the respective cylinder bores 68 into respective sub-chambers 56*a* through 56*f* does not interfere with the gas in the different sub-chambers 56*a* through 56*f*, and thus, the production of vibration in the interior of the compressor can be prevented.

Further, in the present embodiment, since the discharge chamber 56 is formed as a simple annular chamber surrounding the suction chamber 55, all of the sub-chambers 56*a* through 56*f* can be fluidly connected to the external refrigerating circuit by directly connecting one sub-chamber 56*d* to the refrigerating circuit. Therefore, the compressed refrigerant gas discharging from the respective cylinder bores 50 into the sub-chambers 56*a* through 56*f* is repeatedly subjected to expansion and contraction while flowing from respective sub-chambers 56*a*, 56*b*, 56*c*, 56*e*, and 56*f* toward the sub-chamber 56*d* while passing through the fluid passageways 41*a* through 46*a*. Accordingly, pulsative components in the pressure of the compressed refrigerant gas are gradually attenuated before arriving at the sub-chamber 56*d*. Thus, the compressed refrigerant gas delivered from the sub-chamber 56*d* of the discharge chamber 56 toward the external refrigerating circuit can be a pulsation-eliminated flow of the compressed refrigerant gas, and therefore, production of vibration and noise due to pulsative flow of the refrigerant gas under pressure can be sufficiently reduced compared with the conventional compressor having a discharge chamber surrounded by an outer suction chamber in the housing.

Further, it should be appreciated that since the formation of the fluid passageways 41*a* through 46*a* of various radial widths in the ribs 41 through 46 can be achieved simultaneously and integrally with the cast rear housing 57, no cumbersome machining method is needed for forming the flow chokes in the flow of the compressed refrigerant gas within the discharge chamber 56, and accordingly, reduction of the manufacturing cost of the entire compressor can be achieved.

Furthermore, in the compressor having the above-mentioned construction and arrangement of the discharge chamber 56, a lubricating oil component suspended in the compressed refrigerant gas flowing through the fluid passageways 41*a* through 46*a* in the form of a flow choke and through the sub-chambers 56*a* through 56*f* is separated from the refrigerant gas and retained in the sub-chambers 56*a* through 56*f*, and accordingly, the lubricating oil component is not carried away from the interior of the compressor body toward the external refrigerating circuit. Thus, the heat exchanging efficiency of the refrigerating circuit used with a climate control system can be high. In addition, the reciprocating piston type compressor is constantly lubricated during long operation thereof.

Still further, since the flow passageways 41*a* through 46*a* are arranged in such a manner that the flow of the compressed refrigerant gas discharging from the cylinder bores 50 remote from the sub-chamber 56*d* having a direct communication with the delivery passageway is subjected to contractions by the plurality of low chokes becoming gradually larger as the flow approaches the sub-chamber 56*d*, no appreciable loss in pressure of the compressed refrigerant gas occurs before the gas is delivered toward the refrigerating circuit. Thus, the performance, i.e., the compression efficiency of the refrigerant compressor is improved over the compressor according to the prior art.

It should be noted that the provision of the plurality of ribs in the discharge chamber of the housing can contribute to a mechanical enforcement of the compressor, especially a mechanical enforcement of the discharge chamber of the housing subjected to a high pressure of the compressed refrigerant gas.

From the foregoing description of the embodiments of the present invention, it will be understood that the reciprocating piston type refrigerant compressor provided with means suitable for reducing the discharge pressure pulsation of the compressed refrigerant gas according to the present invention can be improved over the conventional reciprocating piston type compressor.

It should further be noted that many modifications and variations will occur to persons skilled in the art without departing from the scope and spirit of the present invention covered by the accompanying claims.

I claim:

1. A reciprocating piston type compressor including:

a cylinder block with a plurality of parallel cylinder bores formed therein and arranged around axial drive shaft for driving reciprocating pistons in the cylinder bores;

a valve assembly arrayed at an axial end of said cylinder block and provided with suction and discharge ports respectively communicating with said plurality of cylinder bores; and a housing means sealingly attached to the axial end of said cylinder block via said valve assembly and defining therein a suction chamber receiving a refrigerant gas before compression and a discharge chamber receiving therein a compressed refrigerant gas, said discharge chamber comprising a delivery ports said suction chamber fluidly communicating with said suction ports of said valve assembly and said discharge chamber fluidly communicating with said discharge ports of said valve assembly, wherein said discharge chamber is isolated from said suction chamber by a wall, and generally extends annularly so as to surround said suction chamber; and wherein said discharge chamber comprises a plurality of sub-chambers communicating, respectively with said plurality of discharge ports of said valve assembly so as to attenuate pulsative components of discharge pressure of said compressed gas discharging from said respective cylinder bores, said sub-chambers being sectioned by radial ribs extending from an end of said housing means toward said valve assembly, said respective radial ribs defining fluid passageways in the form of a flow choke, arranged between ends of said ribs and said valve assembly so as to provide a fluid communication among said plurality of sub-chambers; said radial ribs extending from an inner end face of said housing means which is perpendicular to an axis of the axial drive shaft, toward the valve assembly, said ribs being integral with the inner end face of said housing means:

and wherein said fluid passageways in the form of the fluid choke, defined by said respective ribs are formed in such a manner that sectional areas of said fluid passageways defined by said ribs located closer to said sub-chamber provided with direct communication with said delivery port are larger than those defined by said ribs located far from the same sub-chamber provided with direct communication with said delivery port.

2. A reciprocating piston type compressor according to claim 1, wherein one of said plurality of sub-chambers of said discharge chamber have direct fluid communication with a delivery port delivering said compressed refrigerant gas toward a refrigerating circuit which incorporates therein said reciprocating piston type refrigerant compressor.

3. A reciprocating piston type compressor according to claim 2, wherein said sub-chamber having direct fluid communication with said delivery port is sectioned from neighboring sub-chambers by ribs which are arranged so as to extend from said end of said housing means to define fluid passageways in the form of a fluid choke, and are arranged adjacent to said valve assembly.

4. A reciprocating piston type compressor including:

a cylinder block provided with a plurality of parallel cylinder bores formed therein and arranged around an axial drive shaft for driving reciprocating pistons in the cylinder bores;

a valve assembly arranged at an axial end of said cylinder block and provided with suction and discharge ports respectively communicating with said plurality of cylinder bores; and a housing means sealingly attached to the same axial end of said cylinder block via said valve assembly and defining therein a suction chamber receiving a refrigerant gas before compression and a discharge chamber receiving therein a compressed refrigerant gas, said suction chamber fluidly communicating with said suction ports of said valve assembly and said discharge chamber fluidly communicating with said discharge ports of said valve assembly, wherein said discharge chamber is isolated from said suction chamber by a wall, extending annularly so as to surround said suction chamber; and wherein said discharge chamber comprises a plurality of sub-chambers communicating, respectively, with said plurality of discharge ports of said valve assembly so as to attenuate pulsative components of discharge pressure of said compressed gas discharging from said respective cylinder bores, said sub-chambers being sectioned by radial ribs extending from an end face of said housing means toward said valve assembly, said respective radial ribs defining fluid passageways in the form of a flow choke, arranged between ends of said ribs and said valve assembly so as to provide a fluid communication among said plurality of sub-chambers; said radial ribs extending from an inner end face of said housing means, which is perpendicular to an axis of the axial drive shaft, toward the valve assembly, said ribs being integral with the inner end face of said housing means; and wherein said discharge chamber further comprises one additional sub-chamber having no direct communication with any one of said discharge ports of said valve assembly, and having direct fluid communication with a delivery port delivering said compressed refrigerant gas toward a refrigerating circuit which incorporates therein said reciprocating piston type compressor, said additional sub-chamber being sectioned from neighboring ones of said sub-chambers by ribs which are arranged so as to extend from said end face of said housing means to define fluid passageways in the form of a fluid choke, and are arranged adjacent to said valve assembly, said fluid passageways providing communication between said additional sub-chamber and said neighboring sub-chambers.

* * * * *